US006901826B2

(12) United States Patent
Huang

(10) Patent No.: US 6,901,826 B2
(45) Date of Patent: Jun. 7, 2005

(54) SCREWDRIVER

(76) Inventor: Chin-Tan Huang, No. 39, Lane 240, Liren Rd., Dali City, Taichung County (TW)

( * ) Notice: Subject to any disclaimer, the term of this patent is extended or adjusted under 35 U.S.C. 154(b) by 0 days.

(21) Appl. No.: 10/673,174

(22) Filed: Sep. 30, 2003

(65) Prior Publication Data

US 2005/0066779 A1 Mar. 31, 2005

(51) Int. Cl.[7] ..... B25B 23/16
(52) U.S. Cl. ..... 81/177.2; 81/438
(58) Field of Search ..... 81/177.1, 177.2, 81/177.85, 124.6, 438, 489, 491; 403/17, 403/19, 102, 109.1, 109.5, 326, 367, 374.1, 403/409.1

(56) References Cited

U.S. PATENT DOCUMENTS

| | | | | |
|---|---|---|---|---|
| 3,115,913 | A * | 12/1963 | Yess | 81/177.85 |
| 3,255,792 | A * | 6/1966 | Beck | 81/490 |
| 4,563,912 | A * | 1/1986 | Parks | 74/493 |
| 4,586,406 | A * | 5/1986 | Howard | 81/177.2 |
| 4,692,073 | A * | 9/1987 | Martindell | 408/239 A |
| 4,960,015 | A * | 10/1990 | Mathews | 81/177.2 |
| 5,078,349 | A * | 1/1992 | Smith | 248/125.8 |
| 5,492,430 | A * | 2/1996 | Jones | 403/109.5 |
| 6,089,133 | A * | 7/2000 | Liao | 81/438 |
| 6,354,177 | B2 * | 3/2002 | Peters | 81/439 |
| 6,363,819 | B1 * | 4/2002 | Li | 81/438 |
| 6,389,931 | B1 * | 5/2002 | Delaney et al. | 81/60 |
| 6,408,721 | B1 * | 6/2002 | Lee | 81/60 |
| 6,527,472 | B1 * | 3/2003 | Varnai | 403/370 |
| 6,622,597 | B2 * | 9/2003 | Chen | 81/58.3 |
| 6,643,877 | B1 * | 11/2003 | Amtenbrink et al. | 7/125 |
| 6,722,667 | B2 * | 4/2004 | Cantlon | 279/22 |
| 2004/0020331 | A1 * | 2/2004 | Lee | 81/177.2 |

FOREIGN PATENT DOCUMENTS

EP 295843 A2 * 12/1988 ..... F16M 11/26

* cited by examiner

*Primary Examiner*—Joseph J. Hail, III
*Assistant Examiner*—David B. Thomas
(74) *Attorney, Agent, or Firm*—Rosenberg, Klein & Lee

(57) ABSTRACT

A screwdriver includes a handle having a polygonal hole defined in a first end thereof for allowing an operate shaft extending into the handle. A locking device is mounted in the handle for selective holding the operate shaft in place. A controlling device is mounted to the handle and corresponds to the locking device for forward moving the slider and making the locking device disengaged from the operate shaft for adjusting the total length of the screwdriver.

8 Claims, 14 Drawing Sheets

SCREWDRIVER

BACKGROUND OF THE INVENTION

1. Field of the Invention

The present invention relates to a screwdriver, and more particularly to a screwdriver that having a operate shaft and the length of the operate shaft relative to the screwdriver is adjustable.

2. Description of Related Art

A conventional screwdriver in accordance with the prior art shown in FIG. 17 comprises handle (7), a ratchet device (71) mounted in the handle (7), and a sleeve (72) longitudinally rotatably received in the handle (71) and driven by the ratchet device (71). A tip (8) is partially received in the sleeve (72) and driven by the sleeve (72) for driving a workpiece when the user rotates the handle (7).

However, the sleeve (72) is secured on the ratchet device (71) and the total length of the sleeve (72) and the tip (8) is fixed. Consequently, the user needs to change the tip (8) when limited by the working space and needing a tip having a different length. For favorably finishing a screw operation, the user needs to prepare multiple tips with different lengths. It is very inconvenient for user to prepare multiple tips.

The present invention has arisen to mitigate and/or obviate the disadvantages of the conventional screwdriver.

SUMMARY OF THE INVENTION

The main objective of the present invention is to provide an improved screwdriver that has an adjustable total length.

To achieve the objective, the screwdriver in accordance with the present invention comprises a handle having a polygonal hole defined in a first end thereof for allowing an operate shaft extending into the handle. A locking device is mounted in the handle for selective holding the operate shaft in place. The locking device includes a stopper secured in the handle and having a hole defined therein and extending therethrough. The hole co-axially corresponds to the polygonal hole in the handle. The hole in the stopper includes a tapered section facing the first end of the handle and having a diameter gradually enlarged relative to the first end of the handle. A slider extends through the stopper and partially received in the hole in the stopper. The slider is movable relative to the stopper. The slider has a polygonal hole defined therein and extending therethrough for allowing the operate shaft extending through the slider. Multiple steel balls are buried in the slider and radially extend through the slider. Each steel ball selectively abuts an inner periphery of the tapered section of the hole in the stopper and the outer periphery of the operate shaft to selectively hold the operate shaft in place. A resilient member is mounted around the slider after extending through the stopper for providing a restitution force to make the multiple steel balls engaged to the operate shaft. A controlling device is mounted to the handle and corresponds to the locking device for forward moving the slider and making the multiple steel balls disengaged from the operate shaft.

Further benefits and advantages of the present invention will become apparent after a careful reading of the detailed description with appropriate reference to the accompanying drawings.

DETAILED DESCRIPTION OF THE INVENTION

Figure 1:
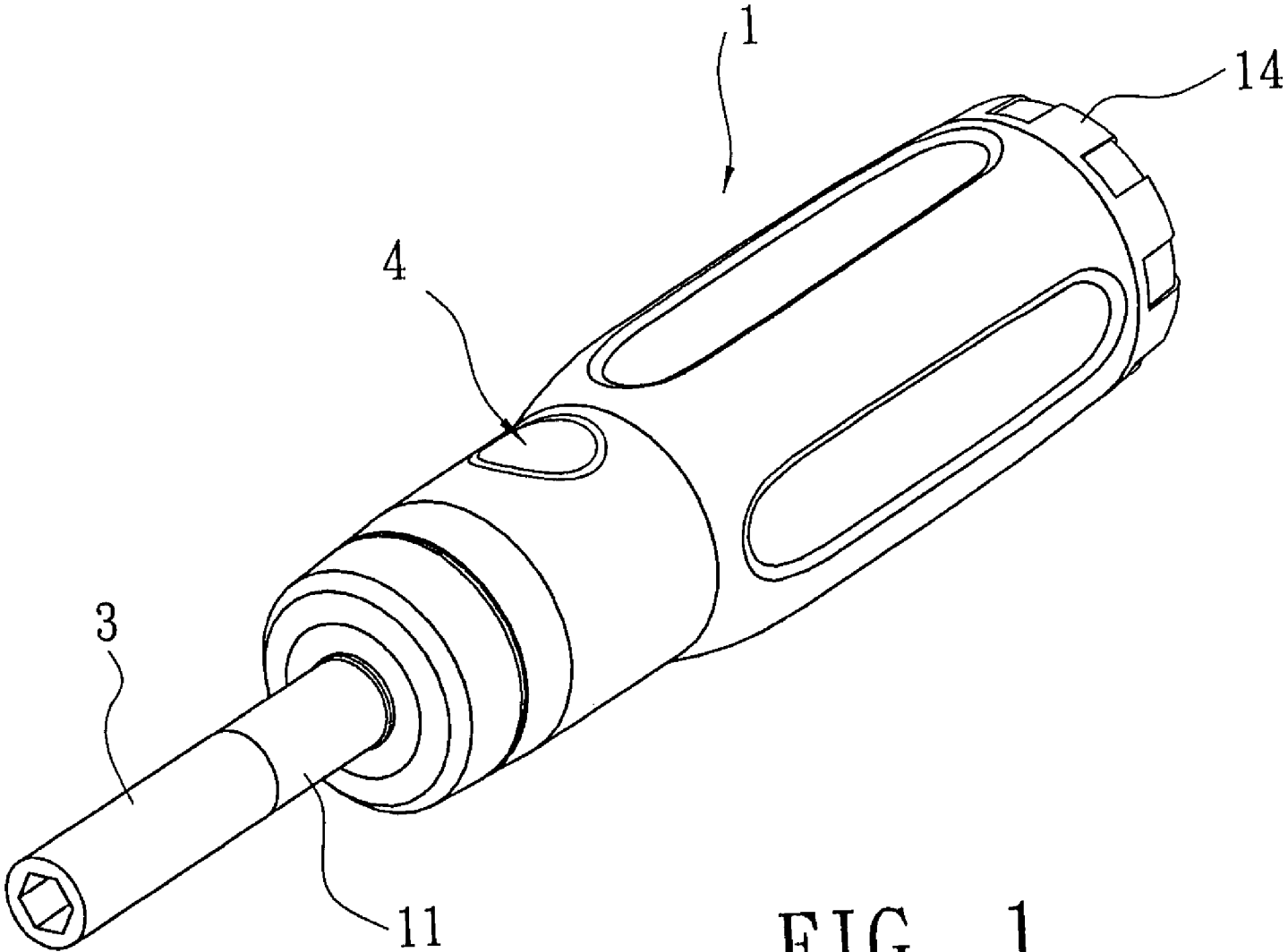
FIG. 1 is a perspective view of a screwdriver in accordance with the present invention.
Figure 2:
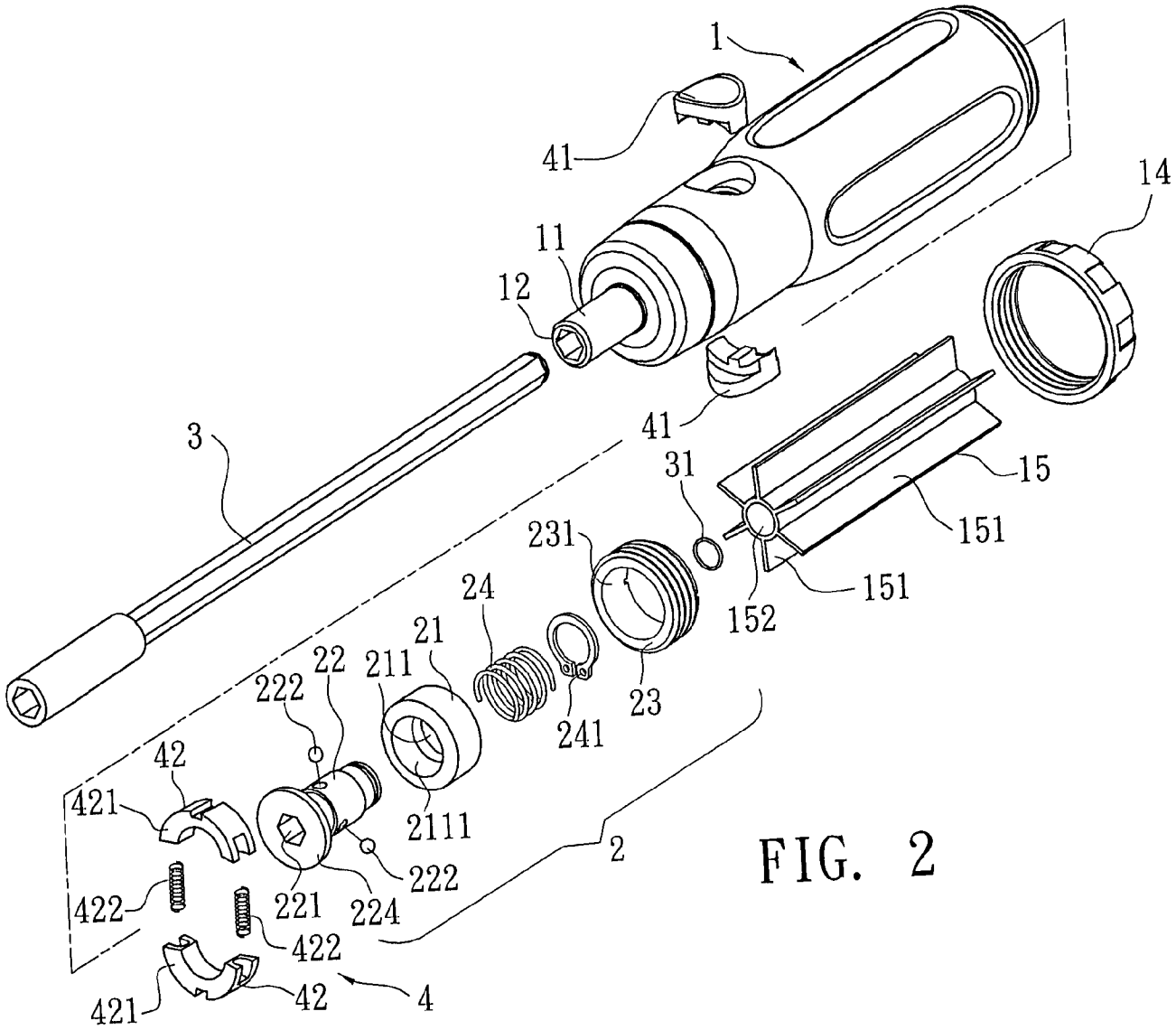
FIG. 2 is an exploded perspective view of the screwdriver in FIG. 1.
Figure 3:
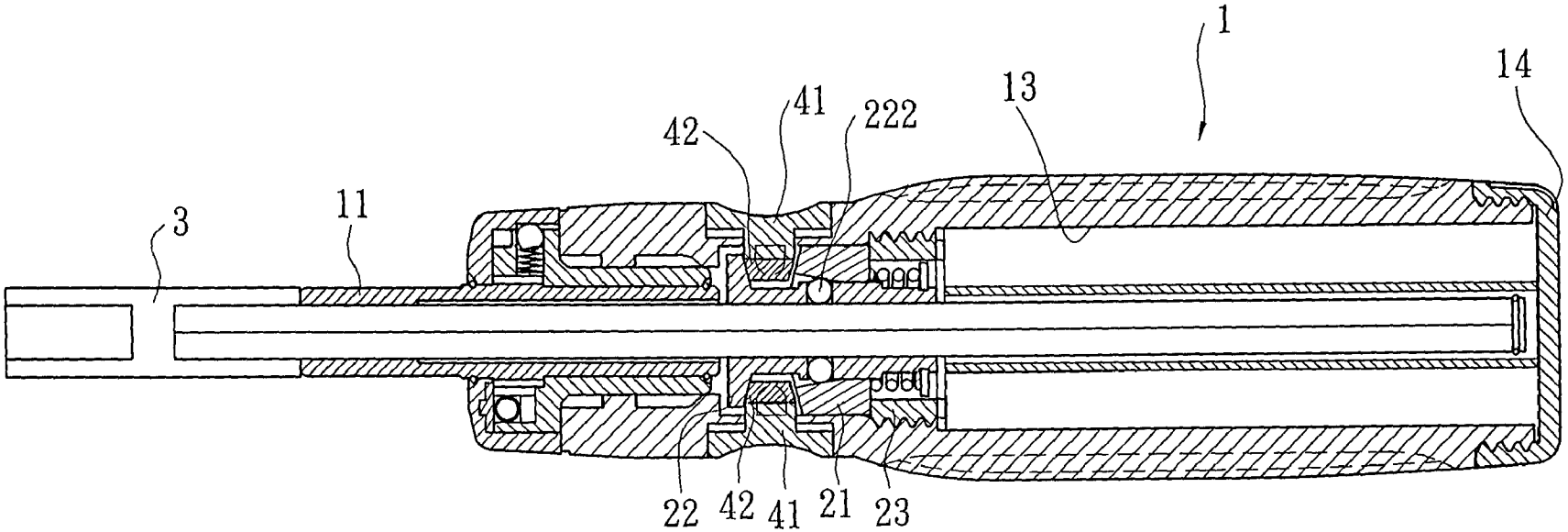
FIG. 3 is a cross-sectional view of the screwdriver in FIG. 1.

Referring to the drawings and initially to FIGS. 1–3, a screwdriver in accordance with the present invention comprises a handle (1), a locking device (2) mounted in the handle (1) and an operate shaft (3) longitudinally extending into the handle (1) and partially received in the locking device (2).

The handle (1) includes a sleeve (11) centrally longitudinally inserted into a first end of the handle (1) and partially securely received in the handle (1). The sleeve (11) has a polygonal hole (12) defined therein and extending through the sleeve (11). A chamber (13) is longitudinally defined in the second end of the handle (1) and a support (15) is longitudinally received in the chamber (13). The support (15) has multiple fins (151) laterally extending therefrom and abutting an inner periphery of the chamber (13). The support (15) has a through hole (152) longitudinally defined therein and aligning with the polygonal hole (12) in the sleeve (11) for partially longitudinally receiving the operate shaft (3). An end piece (14) is secured on the second end of the handle (1) to hole the support (15) in place in the handle (1).

The locking device (2) is mounted in the first end of the handle (1) and includes a slider (22) movably received in the handle (1). The slider (22) includes a polygonal hole (221) longitudinally defined therein and extending through the slider (22) for the operate shaft (3) extending through the slider (22). Multiple steel balls (222) are partially buried in the slider (22) and reciprocally radially moved relative to the slider (22). Each steel ball (222) partially extends into the polygonal hole (221) in the slider (22) for abutting the operate shaft (3) and to an outer periphery of the slider (22). The slider (22) includes a protrusion (224) radially extending from a first end of the slider (22) opposite to the second end of the handle (1). The protrusion (224) has a tapered face having a diameter gradually reduced relative to the second end of the handle (1). A stopper (21) is mounted around the slider (22). The stopper (21) has a hole (211) centrally defined therein and extending therethrough. The hole (211) in the stopper (21) has a tapered portion (2111) formed in one end of the hole (211) in the stopper (21) and corresponding to the tapered face of the protrusion (224). The diameter of the tapered portion (2111) is gradually enlarged relative to the protrusion (224) of the slider (22). Each steel ball (222) abuts the tapered portion (2111) of the hole (211) in the stopper (21). A resilient member (24) is compressively mounted around slider (22) after the slider (22) extending through the stopper (21). In the preferred embodiment of the present invention, the resilient member (24) is a spring. A locking member (241) is mounted to a second end of the slider (22) to hole the resilient member (24) in place. The resilient member (24) has a first end abutting the stopper (21) and a second end abutting the locking member (241). The restitution force of the resilient member (24) backward pulls the slider (22) to make the multiple steel balls (222) securely abut the operate shaft (3) to hold the operate shaft (3) in place due to the tapered portion (2111) of the hole (211) in the stopper (21). A holder (23) is mounted around the second end of the slider (22) and secured in the first end of the handle (1) to hold the stopper (21) in place. The holder (23) has an opening (231) longitudinally defined therein and extending through the holder (23) for receiving the second end of the slider (22).

A C-shaped ring (31) is mounted to one end on the operate shaft (3) and received in the handle (1). The C-shaped ring (31) has a diameter greater than that of the polygonal hole (221) in the slider (22) to prevent the operate shaft (3) from detaching from the locking device (2).

A controlling device (4) is mounted to the first end of the handle (1) and corresponding to the locking device (2). The controlling device (4) includes two buttons (41) movably received in the first end of the handle (1). The two buttons (41) is radially moved relative to the handle (1) and diametrically corresponding to each other. Two pushers (42) respectively connected to a corresponding one of the two buttons (41) and received in the first end of the handle (1). Each pusher (42) has an opposite inclined side (421) facing and relative to the tapered face of the protrusion (224). Two springs (422) mounted between the two pushers (42) for providing a restitution force to the two pushers (42) when the buttons (41) is inwardly pressed.

Figure 4:
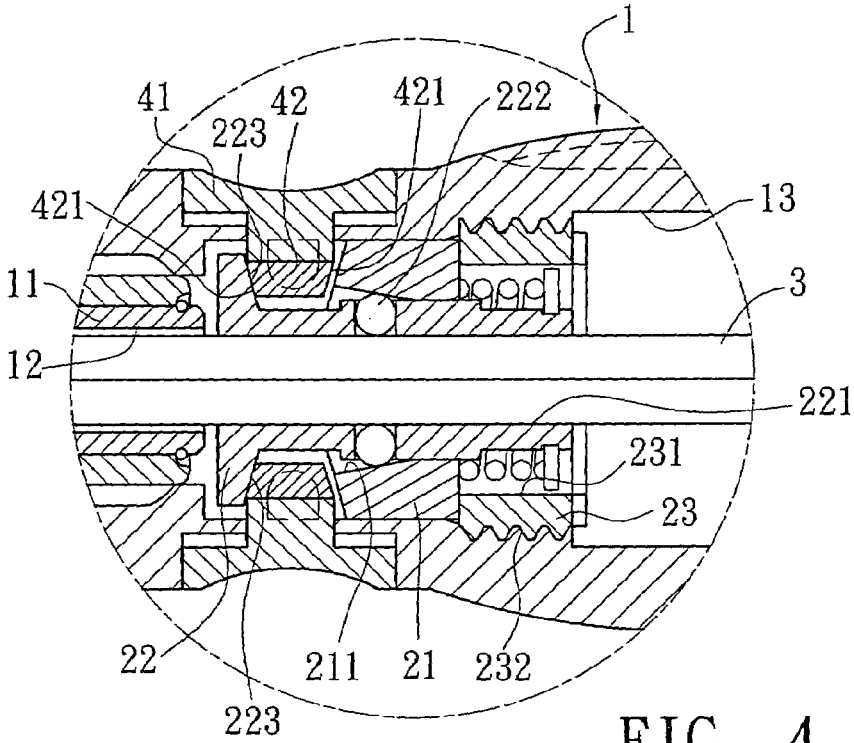
FIG. 4 is a partially enlarged view of the screwdriver in FIG. 3.
Figure 5:
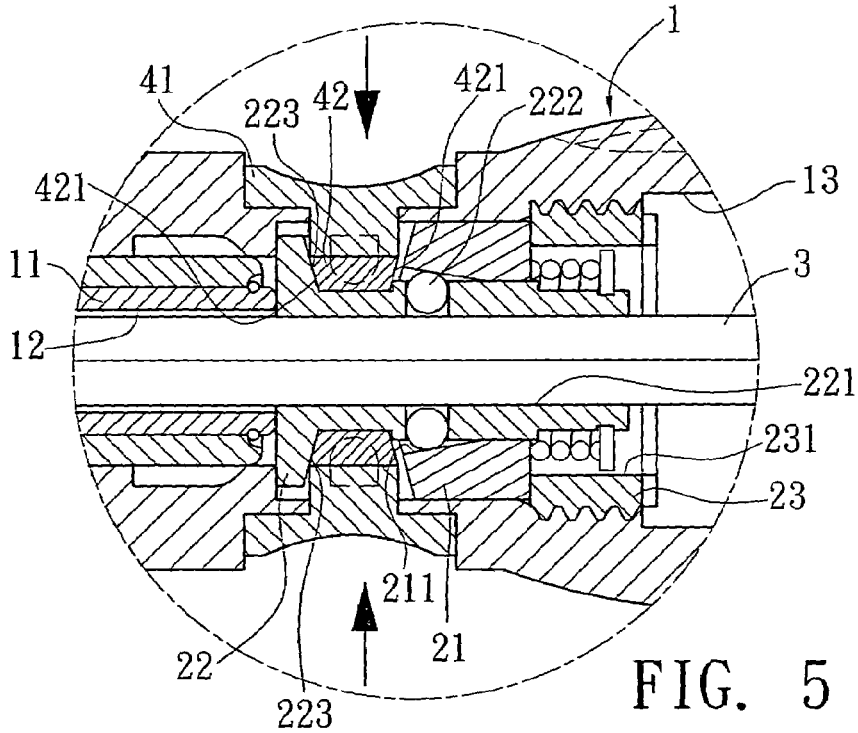
FIG. 5 is an operational cross-sectional view of the screwdriver in FIG. 4.
Figure 6:
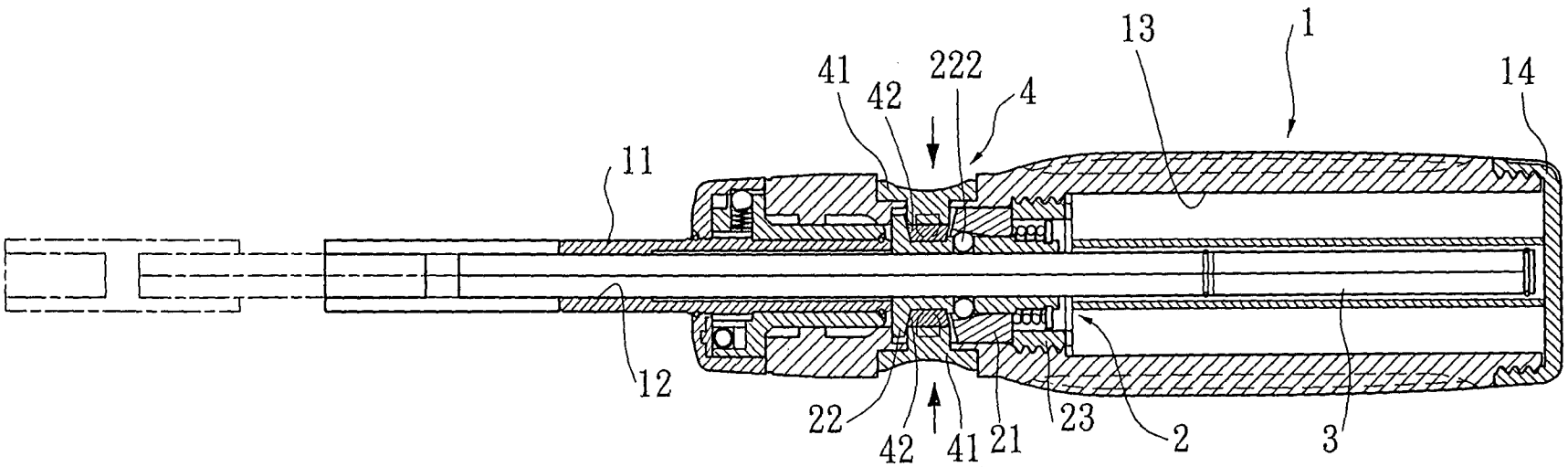
FIG. 6 is an operational cross-sectional view of the screwdriver of the present invention for showing the extending operate shaft.

With reference to FIGS. 4–6, the multiple steel balls (222) is separated from the operate shaft (3) due to the tapered portion (2111) of the hole (211) in the stopper (21) when the buttons (41) with the two pushers (42) are inward moved relative to the handle (1) to push the slider (22) and the resilient member (24) is compressed due to the tapered face of the protrusion (224). Consequently, the multiple steel balls (222) is disengaged from the operate shaft (3) due to the tapered portion (2111) of the hole (211) in the stopper (21) and the operate shaft (3) is in a free condition, that is, the user can freely adjust the length of the operate shaft (3) relative to the handle (1). The two buttons (41) is released and the slider (22) is backwvard moved due to the restitution force of the resilient member (24) when the operate shaft (3) is adjusted to a suitable length. The multiple steel balls (222) engaged to the operate shaft (3) again due to the tapered section (2111) of the hole (211) in the stopper (21).

Figure 7:
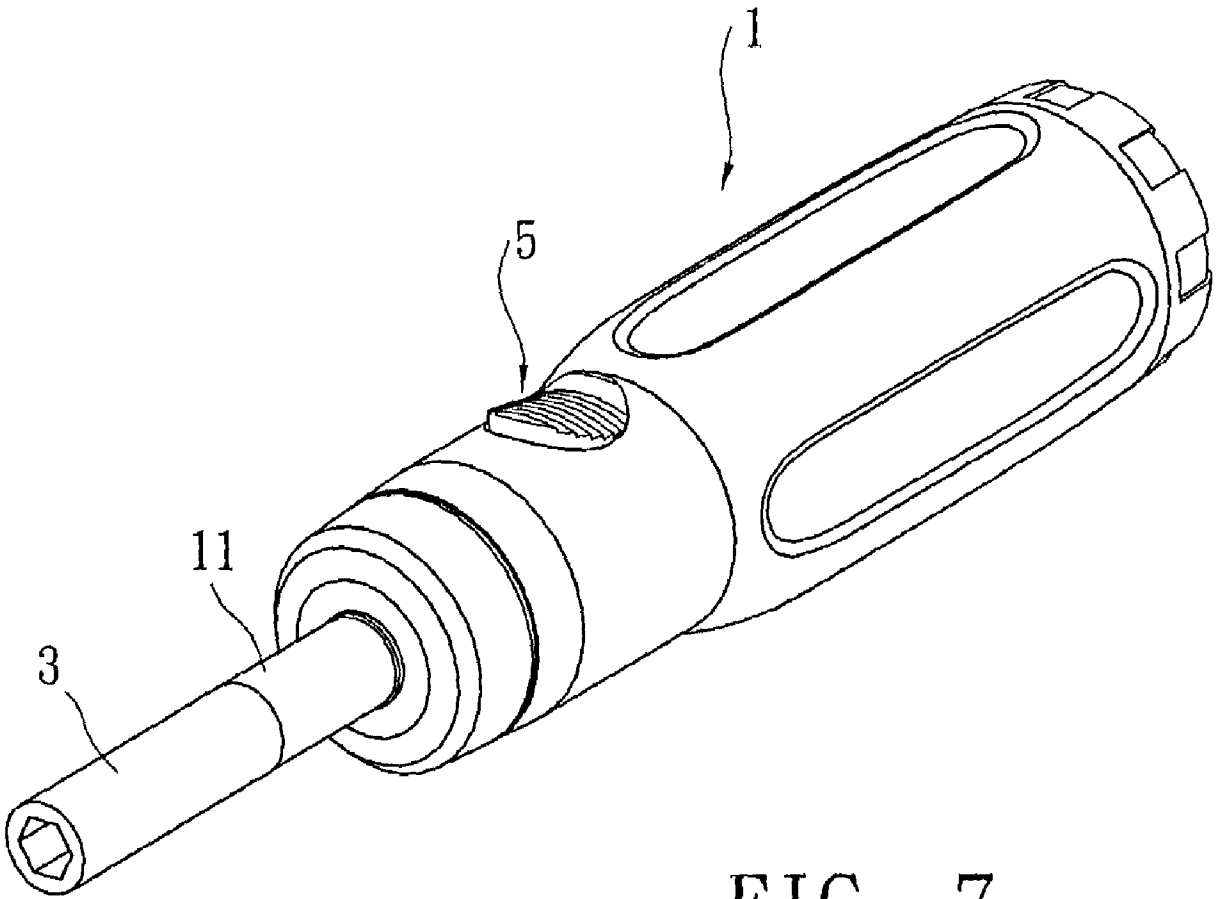
FIG. 7 is a perspective view of a second embodiment of a screwdriver in accordance with the present invention.
Figure 8:
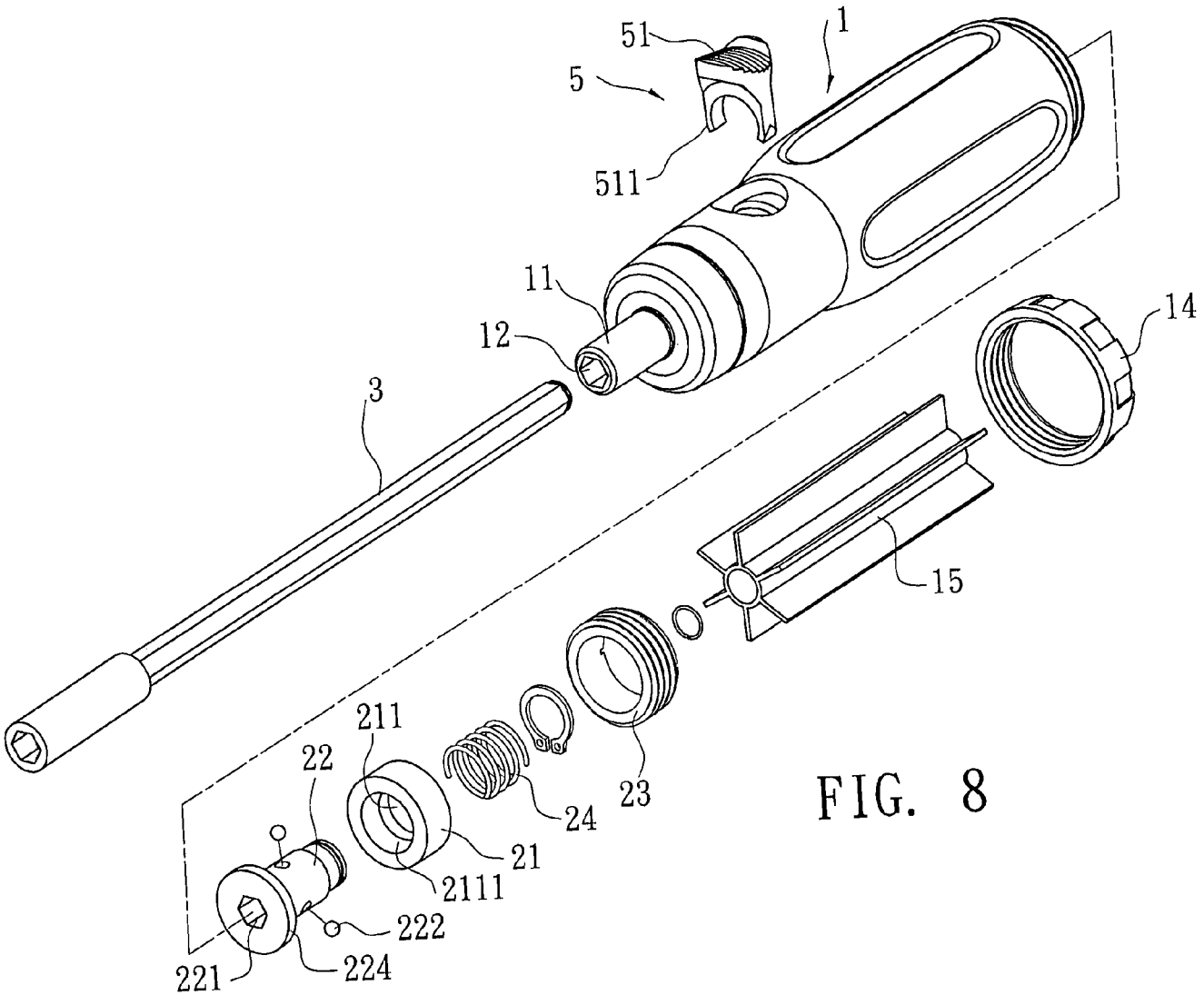
FIG. 8 is an exploded perspective view of the screwdriver in FIG. 7.
Figure 9:
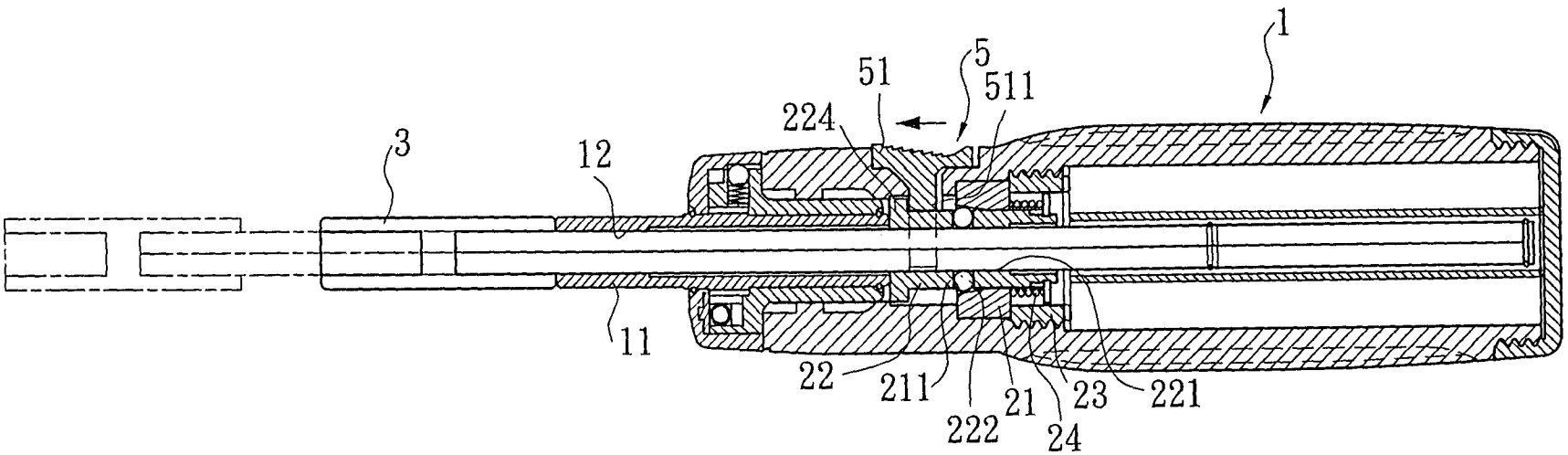
FIG. 9 is an operational cross-sectional view of the screwdriver of the present invention in FIG. 7 for showing the extending operate shaft.

With reference to FIGS. 7–9 that show a second embodiment of the screwdriver in accordance with the present invention, the structures of the slider (22), the stopper (21), the resilient member (24) and the holder (32) are the same as that of the first embodiment of the screwdriver of the present invention. The controlling device (5) includes a button (51) mounted in the first end of the handle (1) and longitudinally moved relative to the handle (1). The button (51) has two pawls (511) respectively extending from two opposite ends of the button (51). The two pawls (511) are mounted to the slider (22) and engaged to the protrusion (224) of the slider (22).

The multiple steel balls (222) is separated from the operate shaft (3) due to the tapered portion (2111) of the hole (211) in the stopper (21) when the button (51) with the two pawls (511) are longitudinally moved relative to the handle (1) to push the slider (22) and the resilient member (24) is compressed. Consequently, the multiple steel balls (222) is disengaged from the operate shaft (3) due to the tapered portion (2111) of the hole (211) in the stopper (21) and the operate shaft (3) is in a free condition, that is, the user can freely adjust the length of the operate shaft (3) relative to the handle (1). The two button (511) is released and the slider (22) is backward moved to the original position due to the restitution force of the resilient member (24) when the operate shaft (3) is adjusted to a suitable length. The multiple steel balls (222) engaged to the operate shaft (3) again due to the tapered section (2111) of the hole (211) in the stopper (21).

Figure 10:
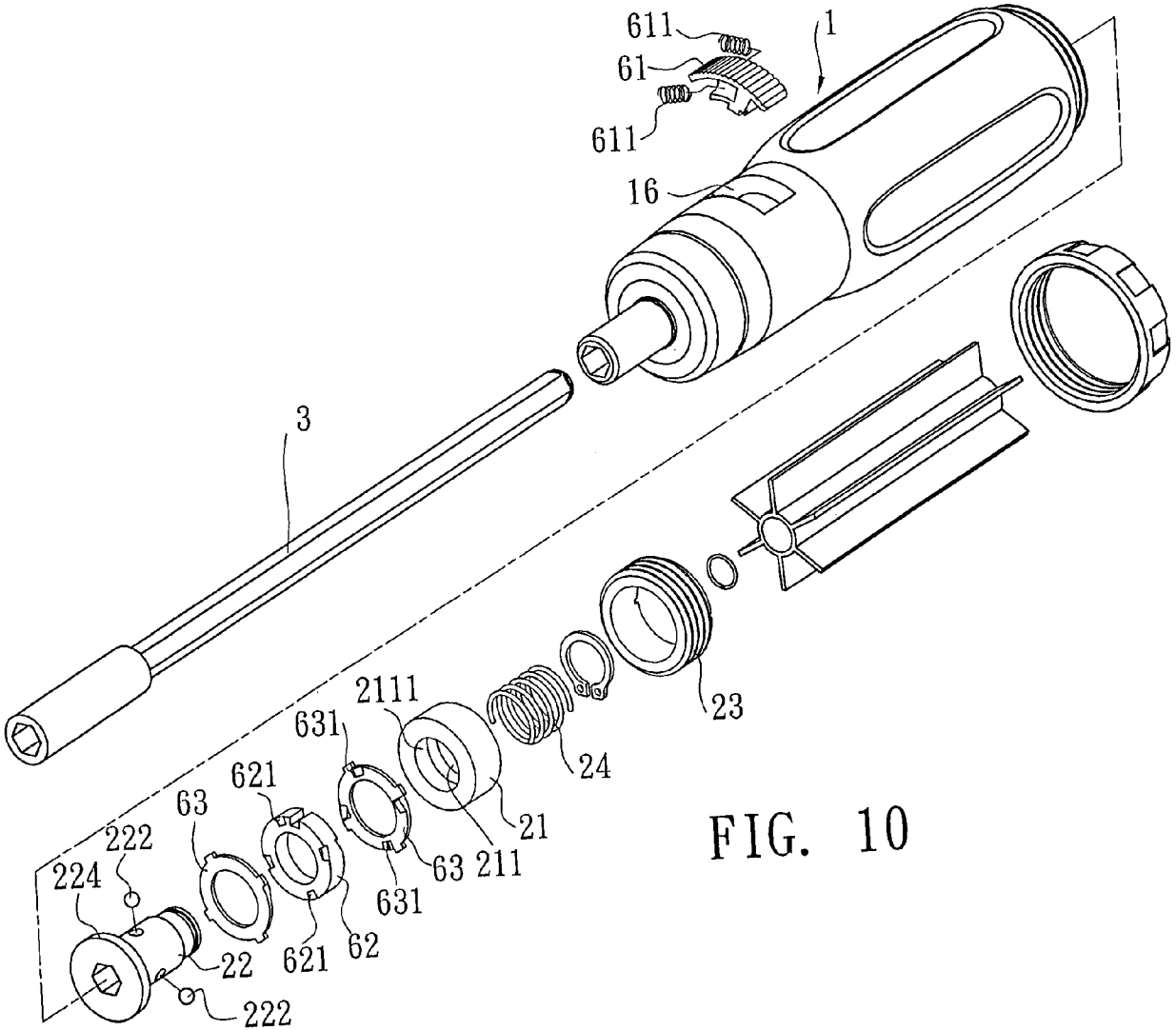
FIG. 10 is an exploded perspective view of a third embodiment of a screwdriver in accordance with the present invention.
Figure 11:
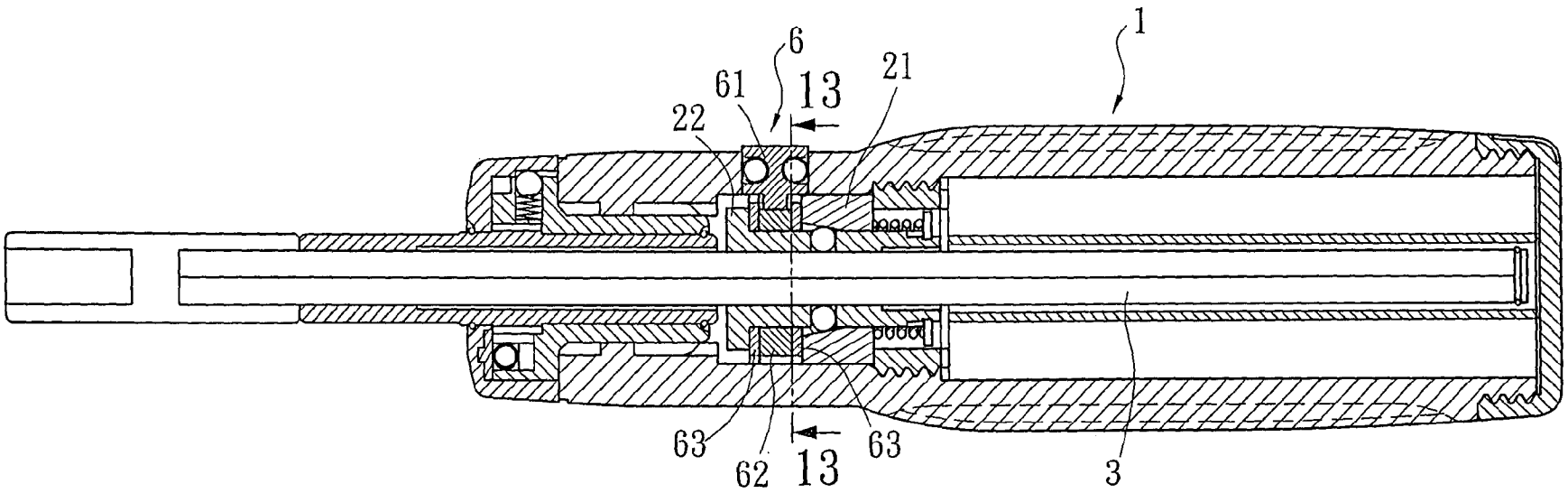
FIG. 11 is a cross-sectional view of a third embodiment of a screwdriver in accordance with the present invention.
Figure 12:
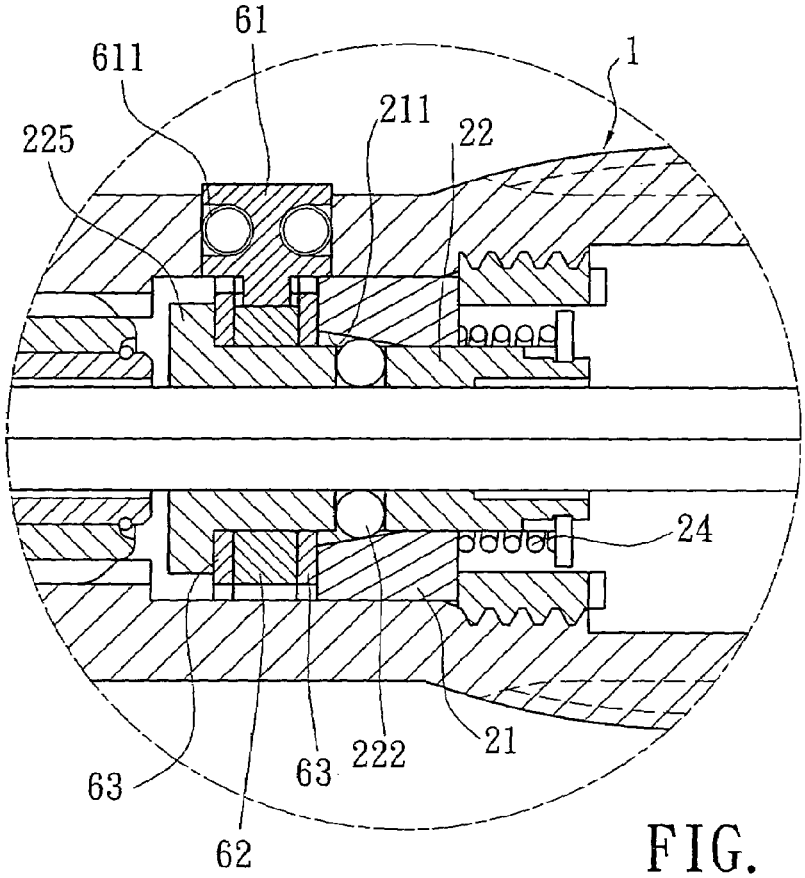
FIG. 12 is a partially enlarged view of the screwdriver in FIG. 11.

With reference to FIGS. 10–12 that show a third embodiment of the screwdriver of the present invention, the structures of the slider (22), the stopper (21), the resilient member (24) and the holder (23) are the same as that of the first embodiment of the screwdriver of the present invention. The locking device (2) further comprises an actuator (62) with two opposite sides and two washers (63) respectively abutting the two opposite sides of the actuator (62). The slider (22) extends through the two washers (63) and the actuator (62) to hold the two washers (63) and the actuator (62) in place in the first end of the handle (1). The actuator (62) includes multiple indentations (621) defined in the two opposite sides thereof and each indentation (621) has an inclined side formed in one side of each of the indentation (621). Each washer (63) has multiple bosses (631) extending therefrom and each received in a corresponding one of the indentations (621) in the two opposite side of the actuator (62). Each boss (631) has an inclined side formed thereon and abutting the inclined side of the corresponding one of the multiple indentations (621) in the actuator (62).

The handle (1) includes an opening (16) defined therein and corresponding to the locking device (2). A button (61) is circuitously movably mounted in the opening (16) and connected to the actuator (62) to prevent the button (61) from be detached from the handle (1). Two springs (611) are mounted between the button (61) and the inner periphery on the opening in the handle (1) to provide a restitution force to the button (61) after being moved.

Figure 13:
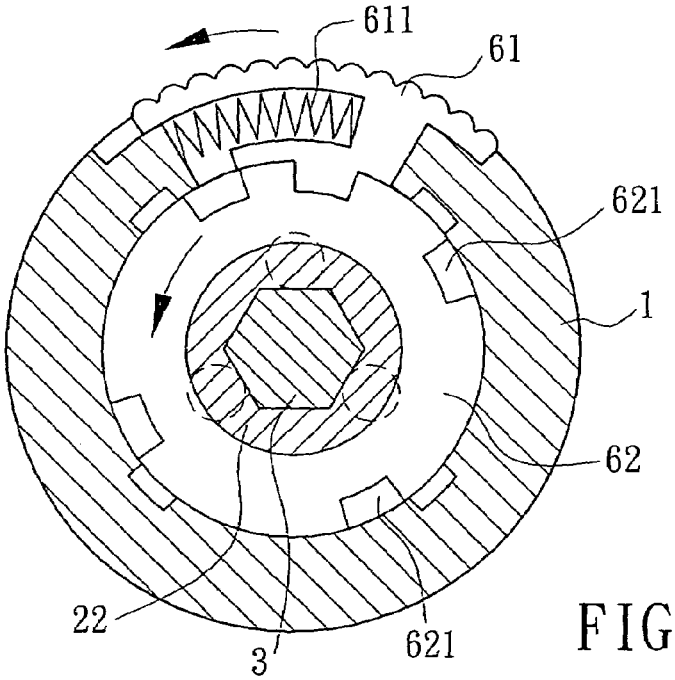
FIG. 13 is a cross-sectional view of the screwdriver in FIG. 11 along line 13—13.
Figure 14:
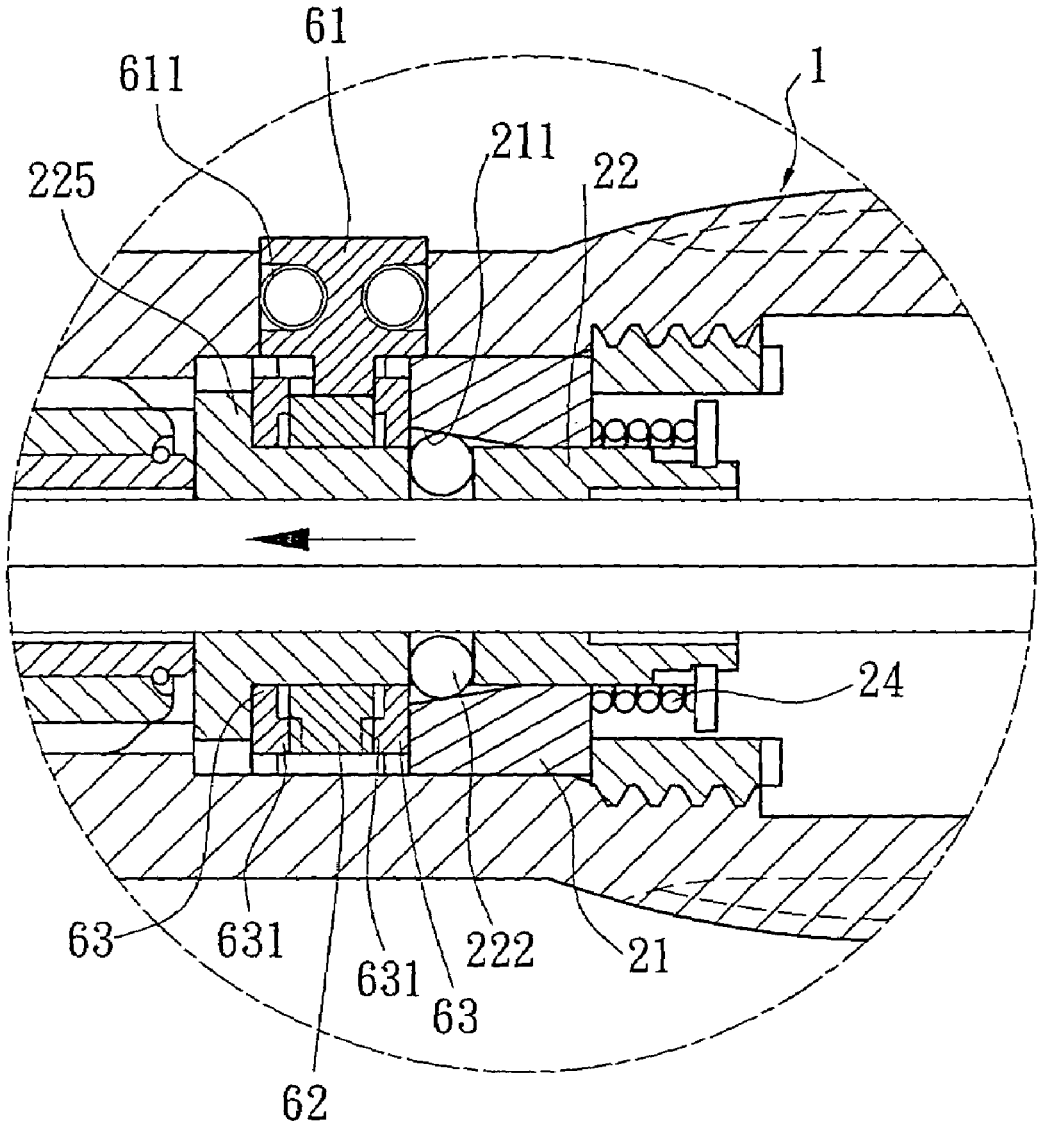
FIG. 14 is an operational view of the screwdriver in FIG. 10.

With reference to FIGS. 13 and 14, the actuator (62) and the washer (63) abutting the protrusion (224) of the slider (22) are forward moved to push the slider (22) when the button (61) is circuitously moved in the opening (16) in the handle (1) and compresses the two springs (611), and the multiple steel balls (222) are disengaged from the operate shaft (3), that is, the operate shaft (3) is in a free condition and the user can freely adjust the length of the operate shaft (3) relative to the handle (1). The button (61) is released and moved to the original position due to the restitution forces of the two springs (611) and the resilient member (24), and the multiple steel balls (222) engaged to the operate shaft (3) again due to the tapered section of the hole (211) in the stopper (21) when the operate shaft (3) is adjusted to a suitable length.

Figure 15:
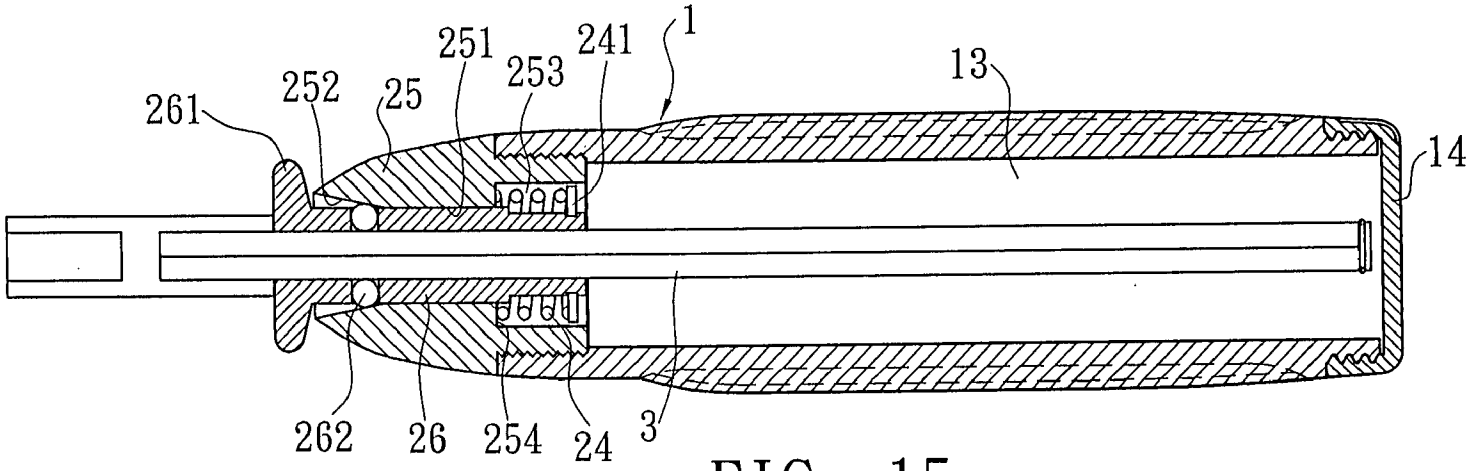
FIG. 15 is a cross-sectional view of a fourth embodiment of a screwdriver in accordance with the present invention.
Figure 16:
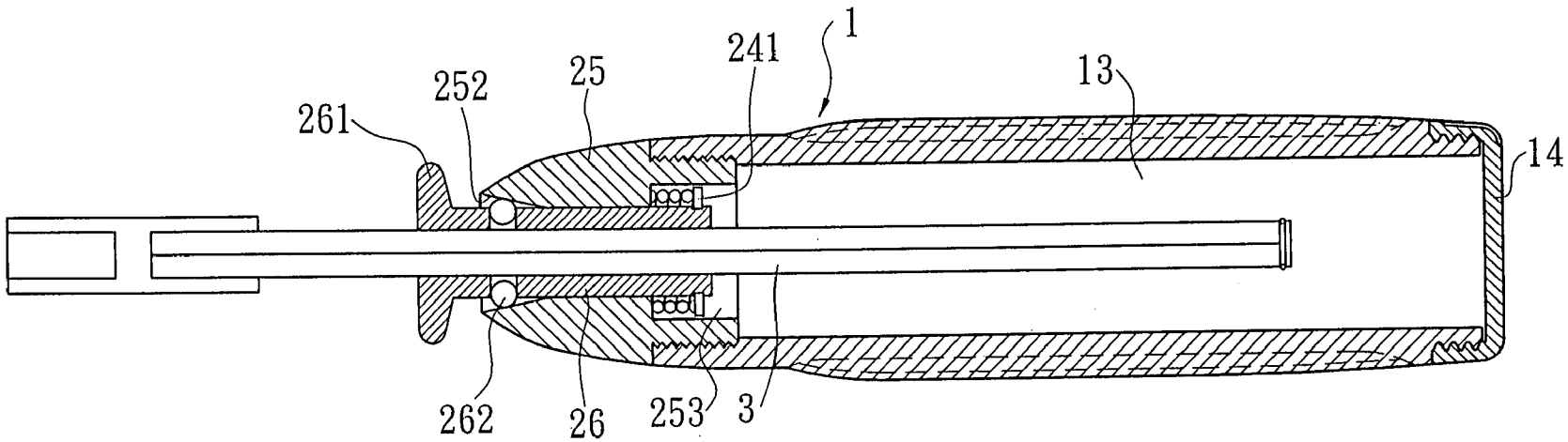
FIG. 16 is an operational view of the screwdriver in FIG. 15.
Figure 17:
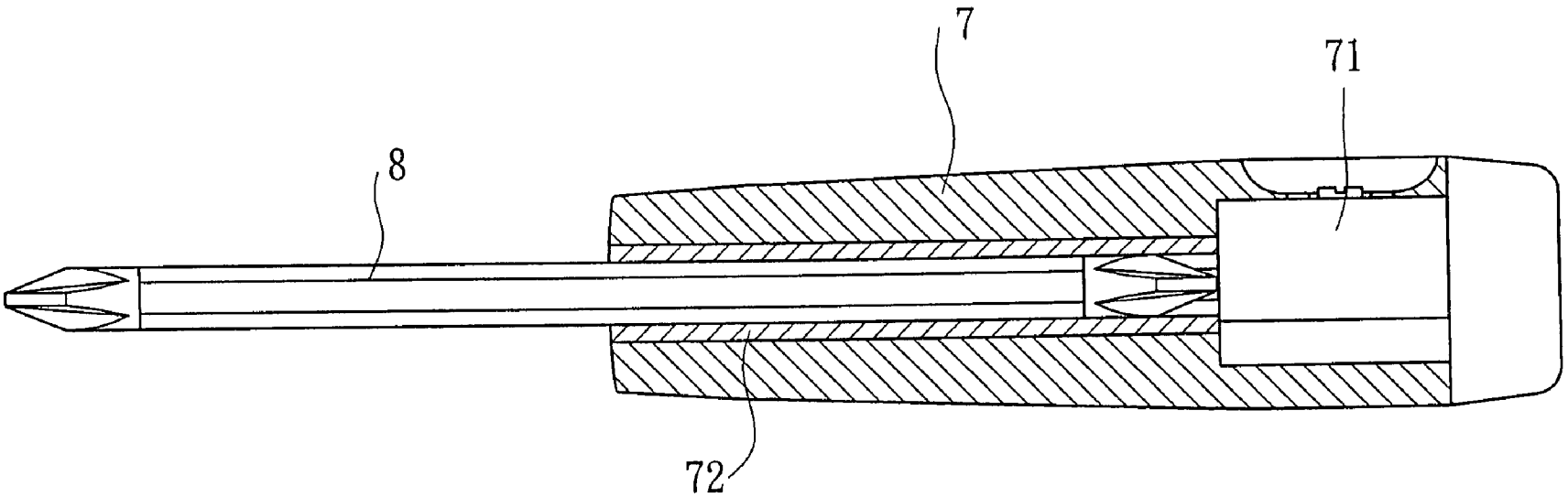
FIG. 17 PRIOR ART
FIG. 17 is a cross-sectional view of a conventional screwdriver in accordance with the prior art.

With reference to FIGS. 15 and 16, the handle (1) includes a receiving space (13) longitudinally defined therein and extending therethrough. An insertion (25) is longitudinally mounted to a first end of the handle (1) and the end piece (14) is longitudinally mounted to a second end of the handle (1) to close the receiving space (13) in the handle (1). The insertion (25) includes a through hole (251) centrally longitudinally defined therein and communicating with the receiving space (13) in the handle (1). The through hole (251) in the insertion (25) has a tapered section (525) defined in a first end of the through hole (251) and an enlarged section (253) defined in a second end of the through hole (251) to formed a shoulder (254) on a bottom of the enlarged section (253). A slider (26) is partially inserted in the through hole (251) in the insertion (25). The slider (26) includes a first end having a protrusion (261) radially extending therefrom and a second end extending to the enlarged section (253) of the through hole (251) in the insertion (25). The operate shaft (3) extends through the slider (26) into the receiving space (13) in the handle (1). Multiple steel balls (262) are buried in the slider (26). Each steel ball (262) extends through the slider (26) and is selectively engaged to the tapered section (252) of the through hole (251) in the insertion (25) and the outer periphery of the operate shaft (3). The resilient member (24) is mounted around the second end of the slider (26) and the C-shaped ring (241) is secured on the second end of the slider (26) to hold the resilient member (24) in place and prevent the slider (26) from detaching from the insertion (25).

The multiple steel balls (262) is disengaged from the operate shaft (3) and the resilient member (24) is compressed when the user forward push the protrusion (261) such that the operate shaft (3) is in a free condition and the user can adjust the length of the operate shaft (3) relative to the handle (1). The protrusion (261) is released, the slider (26) is moved to the original position due to the restitution force of the resilient member (24) and the multiple stele balls (262) engaged to the operate shaft (3) again due to the tapered section (252) of the through hole (251) in the insertion (25).

As described above, the screwdriver in accordance with present invention includes a handle (1), a operate shaft (3) extending into the handle (1) and a locking device (2) mounted in the handle (1) for selectively holding the operate shaft (3) in place such that the total length of the screwdriver of the present invention is adjustable and the screwdriver of the present invention can be used for different work condition, even the work piece is in a bottom of the deep hole.

Although the invention has been explained in relation to its preferred embodiment, it is to be understood that many other possible modifications and variations can be made without departing from the spirit and scope of the invention as hereinafter claimed.

What is claimed is:

1. A screwdriver comprising:

a handle having a polygonal hole defined in a first end thereof for allowing an operate shaft extending into the handle;

a locking device mounted in the handle for selective holding the operate shaft in place, the locking device including a stopper secured in the handle and having a hole defined therein and extending therethrough, the hole co-axially corresponding to the polygonal hole in the handle, the hole in the stopper including a tapered section facing the first end of the handle and having a diameter gradually enlarged relative to the first end of the handle, a slider extending through the stopper and partially received in the hole in the stopper, the slider being movable relative to the stopper, the slider having a polygonal hole defined therein and extending therethrough for allowing the operate shaft extending through the slider, multiple steel balls buried in the slider and radially extending through the slider, each steel ball selectively abutting an inner periphery of the tapered section of the hole in the stopper and the outer periphery of the operate shaft to selectively hold the operate shaft in place, a resilient member mounted around the slider after extending through the stopper for providing a restitution force to make the multiple steel balls engaged to the operate shaft; and a controlling device is mounted to the handle and corresponding to the locking device for forward moving the slider and making the multiple steel balls disengaged from the operate shaft.

2. The screwdriver as claimed in claim 1, wherein the handle comprises a sleeve longitudinally inserted into the first end of the handle, the sleeve having a polygonal hole defined therein and extending therethrough, the polygonal hole in the sleeve aligning with the polygonal hole in the slider, a support received in the receiving space and an end piece mounted to a second end of the handle for closing the receiving and holding the support in place, the support having a through hole defined therein and aligning with the polygonal hole in the slider, multiple fins laterally extending from the support and abutting an inner periphery of the receiving space to divide the receiving the receiving space into multiple chamber for receiving tips with different standards, the locking device is mounted between the sleeve and the support.

3. The screwdriver as claimed in claim 1, wherein the resilient member has a first end abutting the stopper and a second end secured on the slider.

4. The screwdriver as claimed in claim 1, wherein the locking device comprises a holder mounted in the handle to hold the stopper and the slider in place, the holder having an opening defined therein and extending therethrough for allowing the operate shaft extending through the holder.

5. The screwdriver as claimed in claim 4, wherein the slider comprises a protrusion extending from one end of the slider opposite to the stopper and a tapered face formed on the protrusion and facing the stopper, and the controlling device comprises two buttons movably received in the first end of the handle, the two buttons radially moved relative to the handle and diametrically corresponding to each other, two pushers respectively connected to a corresponding one of the two buttons and received in the first end of the handle, each pusher having a inclined side facing and relative to the tapered face of the protrusion for forward pushing the slider, two springs mounted between the two pushers for providing a restitution force to the two pushers when the buttons is inwardly pressed.

6. The screwdriver as claimed in claim 4, wherein the controlling device comprises a button mounted in the first end of the handle and longitudinally moved relative to the handle, the button having two pawls respectively extending from two opposite ends of the button, the two pawls mounted to the slider and engaged to the protrusion of the slider for forward driving the slider.

7. The screwdriver as claimed in claim 4, wherein the locking device comprises an actuator with two opposite sides and two washers respectively abutting the two opposite sides of the actuator, the slider extending through the two washers and the actuator to hold the two washers and the actuator in place in the first end of the handle, the actuator including multiple indentations defined in the two opposite sides thereof and each indentation having an inclined side formed in one side of each of the indentation, each of the washer having multiple bosses extending therefrom and each received in a corresponding one of the indentations in the two opposite side of the actuator, each boss having an inclined side formed thereon and abutting the inclined side of the corresponding one of the multiple indentations in the actuator, the handle including an opening defined therein and corresponding to the locking device, the controlling device including a button circuitously movably mounted in the opening and connected to the actuator to prevent the button from be detached from the handle and drive the actuator.

8. The screwdriver as claimed in claim 7, wherein the controlling device comprises two springs mounted between the button and an inner periphery on the opening in the handle to provide a restitution force to the button after being moved.

* * * * *